United States Patent [19]

Ladd

[11] Patent Number: 4,858,678

[45] Date of Patent: Aug. 22, 1989

[54] VARIABLE HEAT CONDUCTANCE HEAT EXCHANGER

[75] Inventor: Michael M. Ladd, Renton, Wash.

[73] Assignee: The Boeing Company, Seattle, Wash.

[21] Appl. No.: 201,774

[22] Filed: Jun. 2, 1988

[51] Int. Cl.[4] ..... F28F 27/00; F28D 15/00

[52] U.S. Cl. ..... 165/32; 165/104.19; 62/333

[58] Field of Search ..... 165/32, 104.19, 104.17; 62/333, 383

[56] References Cited

U.S. PATENT DOCUMENTS

| | | | |
|---|---|---|---|
| 1,921,147 | 8/1933 | Baird | 62/333 |
| 2,044,609 | 6/1936 | Hedlund | 62/333 |
| 2,499,736 | 3/1950 | Kleen | 62/333 |
| 2,829,271 | 4/1958 | Boucher . | |
| 2,990,693 | 7/1961 | Houplein | 62/333 |
| 3,985,182 | 10/1976 | Hara et al. | 62/333 |
| 4,137,964 | 2/1979 | Buckley . | |

OTHER PUBLICATIONS

"SuperfluidTurbulence", Scientific American, Nov. 1988, pp. 100–108, by Donnelly.

*Primary Examiner*—Albert W. Davis, Jr.

*Attorney, Agent, or Firm*—Seed and Berry

[57] ABSTRACT

A heat exchanger having a variable thermal conductance is disclosed. The thermal conductance varies according to the absolute and relative temperatures between a high-temperature wall and a low-temperature wall. The heat exchanger includes an interior volume having a heat transfer medium therein. Fins extend from the low-temperature wall of the heat exchanger into the interior volume. The heat transfer medium in the fluid phase circulates over the fin surface area to transfer heat by convection and conduction from the high-temperature wall to the low-temperature wall. In the event the temperature of the heat transfer medium decreases, such as by a drop in the temperature of the low-temperature wall or by a decrease in heat flowing through the heat exchanger, a portion of the heat transfer fluid solidifies or freezes, which reduces the effective fin surface area and the circulation area. This reduces the thermal conductance of the heat exchanger. The heat transfer medium is selected based on the requirements of the heat transfer system. The fin configuration, the number of fins, their respective surface areas, and the distance of the fin tip to the high-temperature wall are also selected based on the system heat transfer requirements.

28 Claims, 4 Drawing Sheets

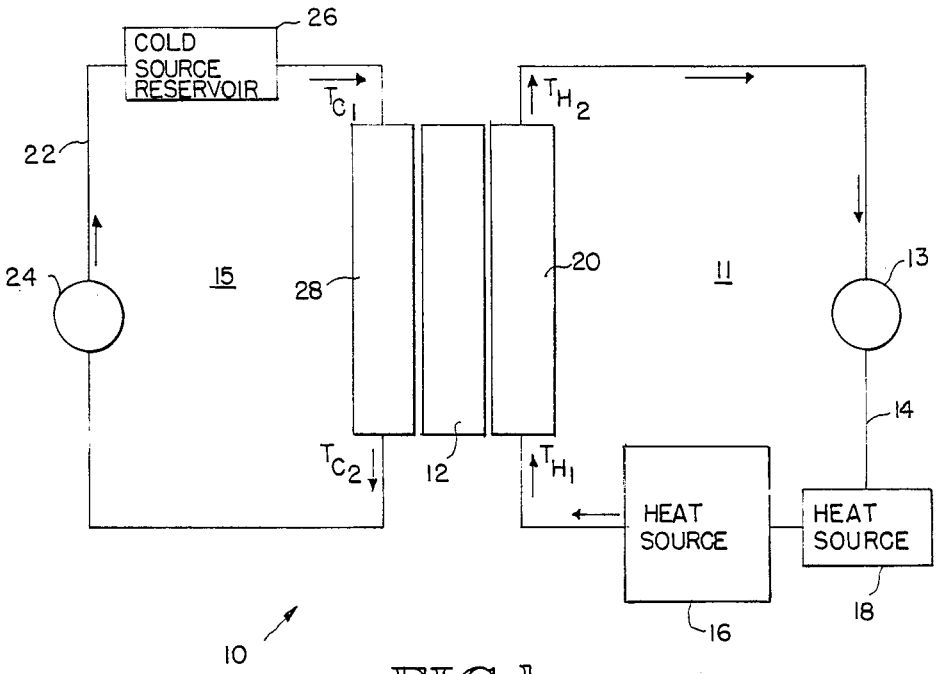
FIG. 1
FIG. 2
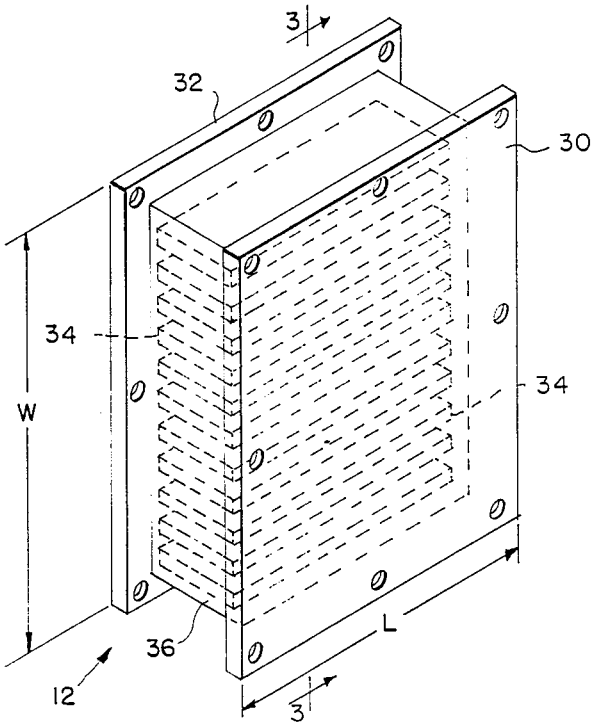

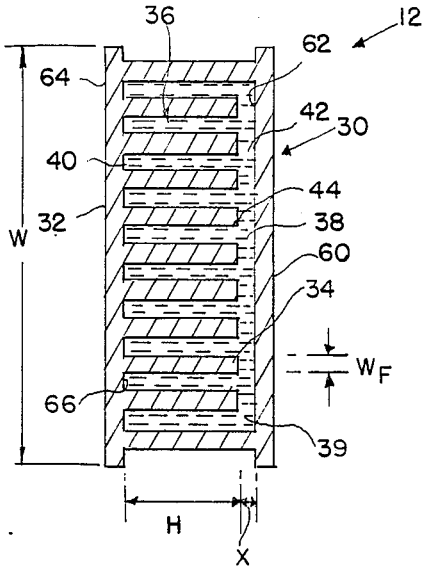
FIG. 3
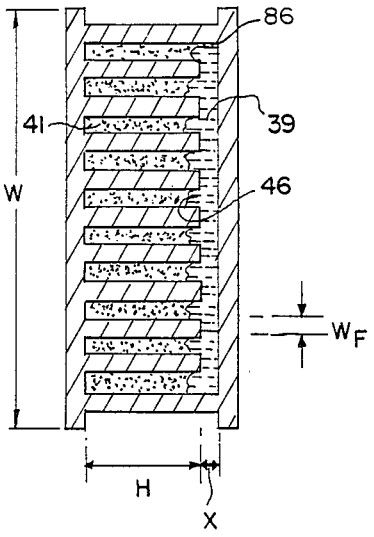
FIG. 4
FIG. 5
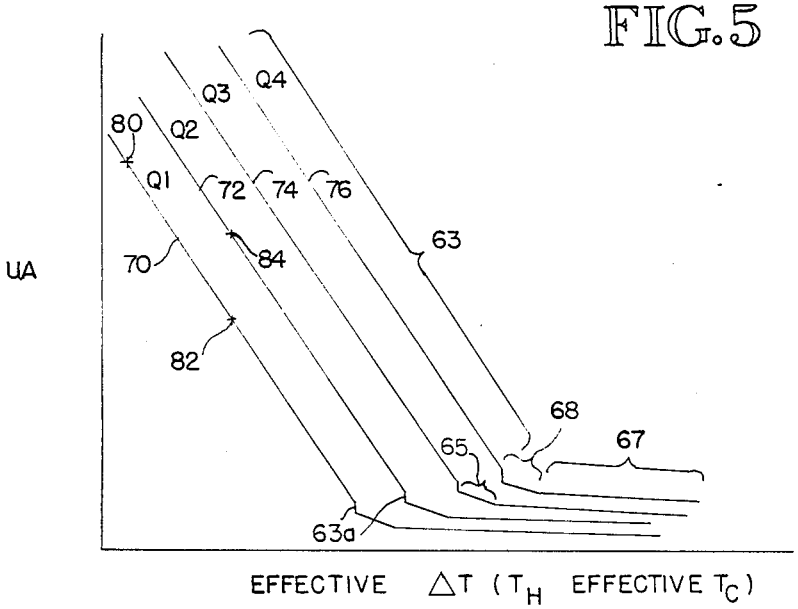

VARIABLE HEAT CONDUCTANCE HEAT EXCHANGER

STATEMENT OF GOVERNMENT INTEREST

The United States Government has certain rights in this invention.

TECHNICAL FIELD

This invention relates to a heat transfer system, and more particularly, to an apparatus and a method of modulating thermal conductance of a heat exchanger to ensure that a constant amount of heat is transferred from a heat source.

BACKGROUND OF THE INVENTION

Removing heat from a relatively constant heat generating system is often required, either to prevent overheating or to provide cooling. One cooling method presently in use is the circulation of a heat transport fluid, such as water, through the system to extract heat. The heat transport fluid is circulated to a cooling location where the heat is extracted. The heat transport fluid circulates in a closed loop system, extracting heat at one location and giving off heat at another location in the system as it circulates. A water-cooled automobile engine using water as the heat transport fluid, a radiator as a heat exchanger, and air as the cooling fluid at the cooling location is an example of this type of heat removal system.

A second type of system is one in which the heat required to be removed from the system fluctuates greatly. For example, a transatmospheric vehicle reentering the atmosphere has a short-term need for a great amount of cooling, even though the cooling requirements while in space may be minimal. A nuclear reactor or large refrigeration unit, such as on a refrigeration truck traveling in alternating hot and cold weather, are other examples of systems whose cooling requirements may fluctuate greatly.

Use of a cryogen cooling fluid to extract heat from the heat transport fluid has been proposed. This is attractive because the low temperature of a cryogen fluid provides greater cooling of the heat transport fluid than is possible using air or water as the cooling fluid. The extraction of large amounts of heat from the heat transport fluid at the cooling location permits smaller heat exchangers to be used.

One disadvantage of using cryogen for the cooling fluid is so much heat may be removed from the heat transport fluid that the heat transport fluid may be frozen. If the heat transport fluid is frozen, circulation is blocked and the system will overheat.

One proposal to prevent freezing of the heat transport fluid is to use temperature feedback from the heat transport fluid to control the flow of the cryogen cooling fluid past the cooling location. According to this proposal, if the temperature of the heat transport fluid is too low, a valve in the flow system of the cryogenic cooling fluid is closed to either restrict the flow volume or slow the rate of flow of the cryogen fluid at the cooling location. Conversely, if the temperature of the heat transport fluid is too high, the valve is opened further to increase the flow volume. This particular solution has the disadvantage of causing cryogen fluid pressure differences or flow oscillations in the cryogen fluid system. Variations in the fluid pressure of a cryogen, such as hydrogen, cause significant changes in the cryogen temperature, heat transfer characteristics, and other thermal properties. This results in the heat extracted from the heat transport fluid being very difficult to predict and control. The heat transport fluid may be frozen at one moment and very hot the next moment due to fluctuations in the thermal properties of the cryogen cooling fluid, even though the system heat generation parameters have not changed. System instability may result if proper controls are not provided. Even if proper controls are provided, they increase the system complexity, weight, and cost.

SUMMARY OF THE INVENTION

It is therefore an object of this invention to provide a heat exchanger assembly that ensures that a constant amount of heat is transferred from a heat transport fluid using a cryogen cooling fluid.

It is another object of this invention to provide a heat exchanger assembly that does not require mechanical movement of elements to vary the heat conductance through the assembly.

It is another object of this invention to provide a heat exchanger having a thermal conductance that varies depending on the temperature of a cooling fluid.

It is another object of this invention to provide a heat exchanger having a thermal conductance that varies depending on the temperature of a heat transport fluid.

These and other objects of the invention are accomplished by providing a heat exchanger assembly thermally separating a cryogen cooling fluid from a heat transport fluid. One wall of the heat exchanger is adjacent the heat transport fluid and one wall is adjacent to the cryogen cooling fluid. Fins extend from the wall adjacent the cyrogen cooling fluid into the interior volume of the heat exchanger. A heat transfer medium is circulated within the interior volume and around the fins. Heat is conducted from the heat transport fluid through the heat exchanger assembly and heat transfer medium to the cryogenic cooling system. The thermal conductance of the exchanger assembly is varied when the heat transfer medium changes phase, such as from liquid to solid. Freezing or solidifying of the heat transfer medium begins at the base of the fin and extends along the tips, towards the tip of the fin. As solid heat transfer medium fills the space between adjacent fins, the thermal conductance of the heat exchanger is modulated. Even if the temperature wall adjacent the cryogen cooling fluid rapidly decreases, the heat transport fluid is not frozen because the heat transfer medium solidifies and the heat exchanger's thermal conductance decreases. The thermal inertia added to the system by the heat exchanger also provides rapid cooling of the heat transport fluid in the event of a rapid rise in the heat transport fluid temperature.

BRIEF DESCRIPTION OF THE DRAWINGS

FIG. 1 is a block diagram of the heat transfer system.

FIG. 2 is an isometric view of the heat exchanger assembly.

FIG. 3 is a cross-sectional view taken along lines A—A of FIG. 4 showing the heat transfer medium at a first temperature, at which it is all fluid.

FIG. 4 is a cross-sectional view taken along lines A—A of FIG. 2 showing the heat transfer medium at a second temperature, at which it is partially fluid and partially solid.

FIG. 5 is a graph of the thermal conductance curves for a sample heat exchanger design.

DETAILED DESCRIPTION OF THE INVENTION

Figure 6:
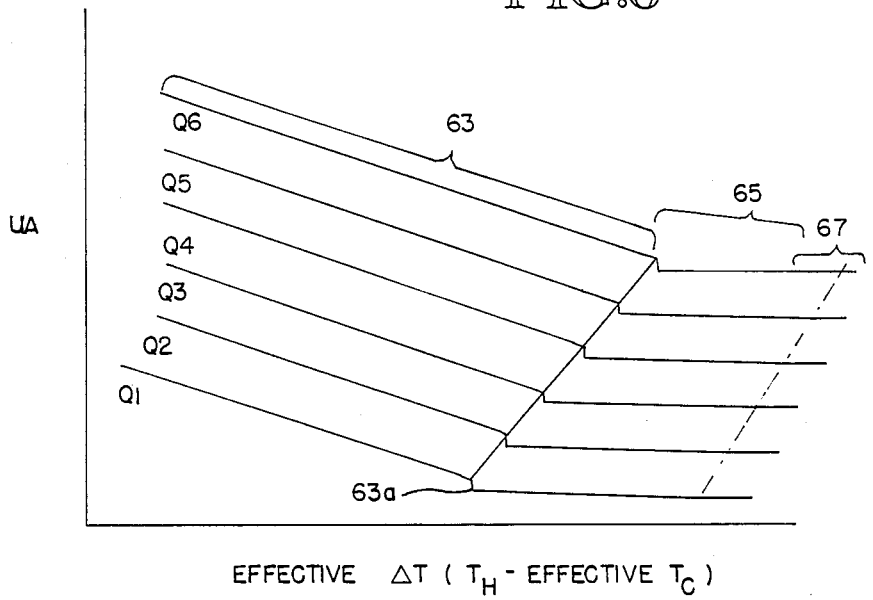
FIG. 6 is a graph of the heat transfer curves for an alternative heat exchanger design.

The heat transfer assembly 10 of the present invention includes a heat transport system 11 and a cryogen cooling system 15 as shown in FIG. 1. The two systems are thermally coupled by a heat exchanger 12.

A heat transport fluid 14 is circulated in a closed loop system using a suitable transport container or conduit. A pump 13 circulates the heat transport fluid through the system. The system includes a relatively constant heat source 18. The constant heat source 18 may be a nuclear reactor or refrigeration unit in the steady state condition. The system may also include a variable heat source 16. The variable heat source 16 may include an aircraft engine, the atmospheric reentry shield of a transatmospheric craft, or a nuclear reactor shutting down or turning on. The heat source 16 is characterized by requiring dissipation of very large amounts of heat at certain times and significantly less heat dissipation at other times. The heat transport system 11 includes a cooling region 20 where heat is transferred from the transport fluid through the heat exchanger to the cooling system 15. The temperature of the heat transport fluid entering the cooling region 20 is $T_{H1}$ and the temperature of the transport fluid leaving the cooling region 20 is $T_{H2}$.

A cryogen cooling fluid source 22 is circulated in the cooling system 15 using a suitable transport container or conduit. A pump 24 circulates the cooling fluid 22 through the system. The system may include a cooling fluid source reservoir 26. On a liquid fueled rocket, this cooling fluid source reservoir 26 may be liquid oxygen, liquid hydrogen, or other fuel source. The cooling system 15 may be an open system with no circulation that expends the cooling fluid after being used. Alternatively, system 15 may be a closed loop circulating system. The cooling fluid portion of the system includes a heat acceptance location 28. The temperature of the cooling fluid entering the heat acceptance location is $T_{C1}$ and the temperature of the cooling fluid leaving the heat acceptance location is $T_{C2}$.

The heat exchanger 12 of FIG. 1 is shown in FIGS. 2–4. The heat exchanger 12 includes a high-temperature wall 30, a low-temperature wall 32, and an interior volume 36, as shown in FIGS. 2–4. A heat transfer medium 38 is within the interior volume 36. The high-temperature wall 30 has an exterior side 60 and an interior side 62. The low-temperature wall 32 has an exterior side 64 and an interior side 66. Fins 34 extend from the low-temperature interior side 66 of the heat exchanger and into interior volume 36. A portion of the heat transfer medium 38 is fluid 39 and a portion is solid 41. The percentage that is fluid 39 depends on the absolute as well as the relative temperatures of the low- and high-temperature walls 30 and 32. The fluid portion 39 circulates around the fins 34, while the solid portion 41 prevents circulations.

The fins 34 have a length L, height H and a width $W_f$, as shown in FIGS. 2 and 3. The total width of all the fins, including the spaces therebetween, is W, as shown in FIG. 2.

The heat extracted by the cryogen cooling fluid 22 is difficult to precisely control, even in a constant flow rate system. The heat transport properties of a cryogen, particularly hydrogen, vary considerably over the heat transport process which may be accompanied by variations in flow rates, variations in pressure gradients within a given volume, and pressure oscillations. Though the present invention minimizes these variations by providing thermal inertia between the cooling region 20 and the heat acceptance region 28, significant variations over time may still exist in the heat transport properties of the cooling fluid 22. The present invention ensures that the heat removed from the heat transport fluid 14 is constant, even though the heat transport properties of the cryogen cooling fluid 22 vary considerably. Therefore, the cryogen cooling fluid entering temperature $T_{C1}$ and exit temperature $T_{C2}$ are not solely determinative of the heat transfer characteristics of the cryogen cooling fluid 22 across the heat acceptance region 28. A more appropriate measure is the temperature of the fins 34 of the interior side 66 of the low-temperature wall 32 of the heat exchanger 12.

The temperature of the low-temperature wall 32 fluctuates considerably, depending on the thermal properties of the cryogen cooling fluid. In a heat transport loop 11 having only a relatively constant heat source 18, the heat exchanger 12 of this invention ensures that a constant amount of heat is extracted from the heat transport fluid 14 even though the thermal properties of the cryogen vary considerably. For example, at a given entering temperature, $T_{H1}$ of the heat transport fluid 14, the exit temperature will always be approximately a selected exit temperature, $T_{H2}$, as shown in FIG. 1, even though the thermal properties and respective temperatures of the cryogen cooling fluid vary considerable.

For a heat transport loop 11 having a greatly fluctuating heat source 16, the heat exchanger 12 is designed to vary the amount of heat transferred from the heat transport fluid 14 to the cooling fluid 22, depending on the temperature of the heat transport fluid. The heat exchanger 12 is designed to provide the maximum thermal conductance when maximum heat is being generated by the heat source 16.

It is not necessary that the low- or high-temperature walls 30 and 32 be constructed of a material having a high thermal conductivity. During operation, the heat exchanger usually is relatively inefficient compared to an optimum thermal efficiency design. The materials for the wall 30, 32 and fins 34 are selected to provide controllable thermal conductivity rather than high efficiency. The heat exchanger design thus differs from conventional heat exchanger designs which maximize thermal efficiency. If desired, for certain applications, the walls 30 and 32 may have a high thermal conductivity such that the temperature on the respective exterior sides is about the same as the temperature on the respective interior sides. Alternatively, depending on the system design, the walls may be a moderate thermal conductor or a moderate insulator.

The fins 34 generally have a very high thermal conductivity but may have a medium to low thermal conductivity, depending on the system design. The material of fins 34 is selected to have a uniform and generally high thermal match to the fluid phase of the heat transfer medium and a uniform but possibly poor thermal match to the solid phase of the heat transfer medium. The fins 34 and heat transfer medium 38 are each selected such that there is a linear or otherwise predictable change between the thermal conductivity of the fin portion exposed to circulating portion 39 of the heat transfer medium 38 and the fin portion covered by the solid portion 41 of the heat transfer medium 38. In a design where maximum operating range is desired, the fins are selected to have a high thermal conductivity for those portions surrounded by fluid heat transfer medium and a low thermal conductivity for those portions covered with solid heat transfer medium 38.

The various phases of the heat transfer medium 38 within the interior volume 34 is shown in FIGS. 3 and 4. In one embodiment, the heat transfer medium is water. In other embodiments, the heat transfer medium is a gel, a gelatin, a mixture of antifreeze and water, an alcohol, ethylene glycol, or another suitable medium that changes from fluid phase to gel phase at a selected temperature. Solid phase 41 includes all those states of the heat transfer medium 38 where circulation of the heat transfer medium is relatively blocked, such as, frozen, gelled, congealed or the like. The amount of blockage caused by congealing, gelling or freezing may be selected as one of the properties of the heat transfer medium 38. A partially solid state, such as congealing or gelling, followed by a frozen solid state at a lower temperature may be desired.

The heat transfer medium 38, in the fluid phase 39, is circulated through the heat exchanger by natural convection currents. The cooler fluid 38 near each fin 34 will descend, while the warmer fluid 38 between the fins or near the high-temperature side 60 will rise with respect to a natural or imposed gravitational field. Further, the cooler fluid 39 near the top of the heat exchanger 12 and the interior side 66 will tend to descend while the warmer fluid 39 rises. This will generally create sufficient convection currents to circulate the heat transfer medium 38 around the fins 34. A forced convection current may be used in the same designs by placing a pump 88 or mechanically/electrically activated diaphragm(s) 86 within the heat exchanger 12 to circulate the fluid portion or the heat transfer medium 38. The circulating pump 88 should be placed near the high-temperature side to ensure continued circulation of the remaining fluid portion even though a majority of it has become solid. The operation of the exchanger is as follows.

When all of the heat transfer medium 38 is in the fluid phase 39, fluid is circulated over the entire fin area plus the interior side 66 of low-temperature wall 32, as shown in FIG. 3. In addition, heat is transferred from wall 30 to wall 32 by convection and conduction of the heat transfer medium and through fins 34. The thermal conductivity of the heat exchanger 12 is relatively high. As the heat transfer medium 38 becomes solid 41, the effective fin height (H) is reduced, thus reducing the fin heat transfer area, as shown in FIG. 4. Further, the amount of heat transferred by convection and conduction through the heat transfer medium is reduced.

Heat transfer during the steady state from the heat transfer medium 38 to the exposed fin portion 34 is described by the following equations.

$$Q = hA * \Delta T \tag{1}$$

where Q is the heat transferred, ΔT is the temperature difference between the heat transfer medium and the fin, and hA is the fin to heat transfer medium 38 thermal conductance.

The fin to heat transfer medium thermal conductance, hA, is determined by the equation:

$$hA = [L * H * 2 * n * N_f] * h_f \tag{2}$$

where L is the fin length, H is the fin height, n is the number of fins, $h_f$ is the film coefficient, and $N_f$ is the fin thermal efficiency coefficient. $N_f$ is defined by the equation:

$$N_f = \frac{\tanh mL}{mL} \tag{3}$$

where tan h is the hyperbolic tangent, L is the fin length, and m is a different equation constant. m is defined by the equation:

$$m = \sqrt{\frac{2 * h_f * (L + W_f)}{K * L * W_f}} \tag{4}$$

where $W_f$ is the fin width and K is the fin material thermal conductivity.

The heat transfer Q of the heat exchanger as a whole is defined by the equation:

$$Q = UA * (T_H - T_C) \tag{5}$$

where UA is the heat exchanger conductance, $T_H$ is the temperature of the high-temperature side, and $T_C$ is the temperature of the low-temperature side.

A significant factor in determining the heat transferred through the fins and thus the thermal conductance of the heat exchanger is the effective fin surface area. The effective fin surface area varies according to the percentage and location of heat transfer medium which is in the solid phase. A large effective surface area of the fins occurs when the cryogen fluid's thermal properties change such that less heat is extracted from the heat transfer medium than would otherwise be extracted. For example, if the mass flow and/or heat transfer coefficient across the heat acceptance region decreases sharply, the cryogen will extract less heat than when the mass flow and/or heat transfer coefficient are higher. This particular problem often occurs when using a cryogen as the cooling fluid. When the cryogen fluid is warmer or otherwise extracting less heat, the low-temperature wall 32 rises in temperature. A large percentage of the heat transfer medium 38 becomes more fluid, thus increasing the thermal conductance of the heat exchanger 12. When the thermal conductance of the heat exchanger is high, more heat is removed from the heat transport fluid for a given temperature difference between walls 30 and 32. Thus, the desired amount of heat is removed from the heat transport fluid 14 to provide the required cooling. When the cryogen begins to extract more heat due to a decrease in the effective temperature of cryogen 22, the wall 32 drops in temperature and the medium begins to turn solid, thus decreasing the effective fin surface area. This reduces the thermal conductance of the heat exchanger. Even though the cryogen fluid is colder, the same constant amount of heat is removed from the heat transport fluid. The exit temperature $T_{H2}$ of the heat transport fluid 14 remains constant even though $T_{C1}$ and $T_{C2}$ are much lower.

The heat transfer medium 38 turns solid beginning at the base of the fins and extending towards the high-temperature wall. The fluid portion of the heat transfer medium 38 continues to circulate within the interior volume and around that portion of the fins which is not blocked by said heat transfer medium. As the fin effective surface area decreases, the fin to heat transfer medium thermal conductance decreases. In the event the entire fin, including the tip, is completely covered, the thermal conductance of the heat exchanger significantly decreases. For this situation, the heat transfer medium is fluid in the region 46 between the tip 44 of fin 34 and wall 30. The thermal conductance of the heat exchanger 12 in this condition is related to the thermal conductivity of the fluid heat transfer medium from the high-temperature side 62 through the solid portions of the heat transfer medium 38 and then to the fins 34. As more of the heat transfer medium 38 becomes solid, thermal conductance of the heat exchanger decreases accordingly.

The distance between the tip 44 of the fin and the high-temperature side 62 is selected according to the desired characteristics of each application. Generally, the distance will be relatively small, such that once the fin is completely covered with solid phase heat transfer medium, the temperature gradient from the solid/liquid interface of the heat transfer medium to the low temperature wall 32 will increase and prevent freezing of the remaining liquid phase heat transfer medium. For some applications, the distance from the tip 44 to the wall 62 may be relatively large to provide a buffer of heat transfer medium even when the temperature of the wall 32 is low.

Figure 7:
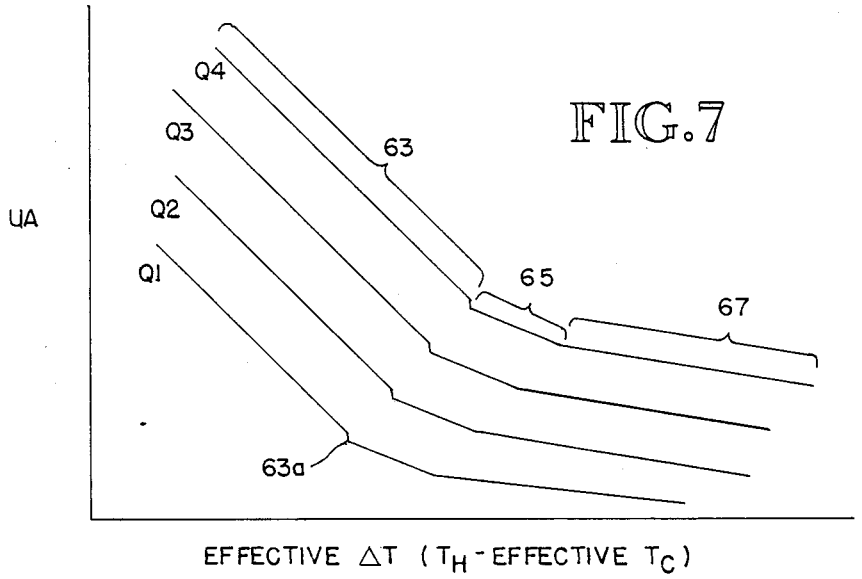
FIG. 7 is a graph of the heat transfer curves for an alternative heat exchanger design.

Examples of heat transfer curves for various heat exchangers are illustrated in FIGS. 5–7. The heat transfer lines illustrated in the graph of FIG. 5 are for a heat exchanger designed to transfer a constant amount of heat out of a heat source even though the low-temperature wall 32 temperature varies considerably. The low-temperature wall 32 temperature is determined from those properties that affect the heat transfer characteristics of the cryogen, including temperature, pressure, flow rate, and the like. The horizontal axis represents the temperature difference, $\Delta T$, between the high-temperature wall 30 and the low-temperature wall 32. The vertical axis represents the thermal conductance, UA, of the heat exchanger 12 as a whole. Each of the lines 70, 72, 74 and 76 represents a constant heat transfer curve across the heat exchanger.

Using the heat exchanger 12, designed to operate as shown in FIG. 5, when the effective temperature of the cryogen fluid is relatively high, the $\Delta T$ between walls 30 and 32 is low. This is represented as region 63 on line $Q_1$ of FIG. 5. Even when the temperature at wall 32 is relatively high, it will always be lower in temperature than wall 30 such that some cooling is always provided to the heat transfer medium 38. The majority of the heat transfer medium 38 is in the fluid state and is circulated around the fins 34. The thermal conductance, UA, is relatively high; and a desired amount of heat is being extracted from the heat transport fluid 14, as represented by the point 80 on line 70 of FIG. 5. When the temperature of the cryogen cooling fluid drops, pressure increases, flow rate increases and the like, the temperature at wall 32 drops and the $\Delta T$ increases. This causes a portion of the heat transfer medium 38 to become solid, which decreases the convection heat transfer and the effective fin transfer surface area. The thermal conductance of the heat exchanger 12 is significantly reduced, as shown by line 70. A constant amount of heat, Q1, is still being removed from the heat transport fluid, even though the effective temperature of the low-temperature wall 32 is much less. The heat exchanger is still operating in region 63. This ensures that the heat transfer fluid has a constant exit temperature, $T_{H2}$, shown in FIG. 1 for a constant entering temperature, $T_{H1}$. The new operating point may be represented by point 82 on line 70 of FIG. 5.

The effective temperature of the cryogen cooling fluid may change considerably, from high to low, and a constant amount of heat will be drawn from the heat transport fluid. This is because the thermal conductance of the heat exchanger varies according to the temperature difference between the high-temperature wall 30 and the low-temperature wall 32. When the temperature difference is low, the thermal conductance is high to conduct heat easier, but when the temperature difference is high, representing a very cold wall 32, the thermal conductance is lower.

In the event the heat generated by the heat source 18 increases, the temperature of the heat transport fluid 14 increases. More heat must be extracted from the heat transport fluid 14 to ensure that the exit temperature $T_{H2}$ is constant, even though the entering temperature $T_{H1}$ has risen. This causes some of the heat transfer medium 38 to change from solid to fluid, exposing more fin surface area and increasing the thermal conductance of the heat exchanger 12. The heat transferred, $Q_2$, is greater, as shown by point 84 on line 72. The exit temperature $T_{H2}$ thus remains constant as more heat is extracted by the cryogen cooling fluid due to the increased thermal conductance of the heat exchanger 12, caused by a rise in $T_{H1}$. In the event more heat is generated by the heat source 18, further raising the temperature $T_{H1}$, the heat transferred may increase, as represented by heat transfer lines $Q_3$ and $Q_4$. Only four lines are shown in FIG. 5, but it is to be understood that there are an infinite number of constant heat transfer curves between $Q_1$ and $Q_4$, the expected operating range of that particular heat exchanger.

The heat transfer medium 38 of the heat exchanger 12 of FIG. 5 is selected to have a low thermal conductivity in the solid state compared to the thermal conductivity in the circulating fluid state. When a portion of the heat transfer medium 38 has changed from fluid to solid, the effective surface area of the fin decreases. Because the thermal conductivity of the solid portion 41 of heat transfer medium 38 is low, the effective fin surface area largely determines the thermal conductance of the heat exchanger 12.

As the fin surface area area decreases, the thermal conductance of the heat exchanger decreases with a generally uniform slope, illustrated as region 63 in FIG. 5. Just as the tip 44 becomes completely frozen over, the thermal conductance of the heat exchanger makes a greater change over a given temperature difference than experienced when operating in region 63. This is represented by region **63*a* in FIG. 5 having a steeper slope than region 63. Region 63*a*** represents the transition from having some of the fin area (the tip) exposed, to the state where none of the fin surface area is exposed.

In the event the cryogen attains a very low effective temperature, the effective $\Delta T$ is very large. The heat transfer medium will be turned to solid along the entire fin and around the tip of the fin, making the exposed surface area of the fin zero. This is represented by the region 65 in FIG. 5. The thermal conductance of the heat exchanger is very low, which will ensure that the desired amount of heat is removed from the heat transport medium 14 without freezing it even with a very low temperature at 32. A portion of the heat transfer medium between the fin tip 44 and the side 62 remains fluid and circulates.

In the event all the heat transfer medium 38 becomes solid, circulation of the heat transfer medium 38 stops and the thermal conductivity of the heat transfer medium reaches a minimum, as represented by region 67 in FIG. 5. For a heat transfer medium 38 in the solid state having a very low thermal conductivity, the heat exchanger is effectively an insulator. This feature prevents so much heat from being removed from the heat transport fluid 14 that it is frozen.

Control of the heat exchanger's thermal conductance in regions 65 and 67 is not as precise as it is in region 63. The heat exchanger 12 and heat transfer medium 38 are selected and designed to operate at all times in region 63. However, should the temperature of the heat transport fluid 14 drop or the effective temperature of the cryogen cooling fluid 22 decrease, the regions 65 and 63 provide safety regions to ensure that the system continues to operate and that undesirable freezing of the heat transport fluid 14 does not occur.

A further safety measure is to select a heat transfer medium 38 having a freezing point at a higher temperature than the freezing point of the heat transport fluid 14. The heat transfer medium 38 will always be lower in temperature than the heat transfer medium 14, as it is closer to the cooling cryogen fluid 22. If the freezing temperature of the heat transport fluid 14 is approached, the heat transfer medium will freeze first and then cause the heat exchanger 12 to become an effective thermal insulator. This ensures that the heat transport fluid is never frozen.

The heat exchanger design of FIG. 6 operates on similar principles to the heat exchanger of FIG. 5; however, some of the design parameters are different. The distance from the fin tip 44 to the wall 30 is relatively large. This significantly increases the effective $\Delta T$ operating range after the entire fin is covered by solid heat transfer medium 38. This may be desired if a large thermal mass is desired to be placed between the heat transport fluid 14 and the cryogen cooling fluid. The large thermal mass may also provide thermal inertia to absorb large amounts of heat when being turned from solid to fluid.

A second, independent change, illustrated in FIG. 6, is a heat transfer medium having a thermal conductivity in the solid phase more similar to the thermal conductivity in the fluid phase. The variation in thermal conductivity of the heat exchanger 12 for a given effective $\Delta T$ is not as great as for the heat exchanger of FIG. 5. Thus, the slope of the constant heat transfer lines Q1–Q6 is not as steep. This property of the heat transfer medium may be used in any heat exchanger design, whether the distance from the fin tip 44 to the side 62 is relatively large or small.

A different heat exchanger design having a different heat transfer medium 38 operates as shown in FIG. 7. The slope of the heat transfer curves in the region 63 may be selected according to the desired heat transfer medium. The fin dimensions and distance from the fin tip 44 to wall 62 may also be selected according to the needs for each specific application.

The heat exchanger 12 has the fins extending from the low-temperature side 66. This provides a uniform change in the thermal conductance of the heat exchanger when there are great variations in the cooling cryogen's effective temperature. Heat is transferred along the fins to the cold fluid side. Circulation continues around the exposed portion of the fin and heat is transferred to the heat sink 22. Fins may extend from the high-temperature side 60 into the interior volume 36 to improve the thermal conductivity into the heat transfer medium 38 from the heat transport fluid, if desired. The fins should not contact the fins extending from the low-temperature side 64, though they may be interdigitated if desired.

The heat exchanger 12 may also be designed to absorb large amounts of heat given off by a sudden increase in heat generation from a variable heat source 16. The heat exchanger may have longer fins, tapered fins, or fins having other fins extending from them at different regions within the heat exchanger. The heat exchanger may also have pins, tapered pins or pins having other pins extending from them at different regions within the heat exchanger. The heat exchanger may also have any combination of said fin or pin configurations.

Figure 8:
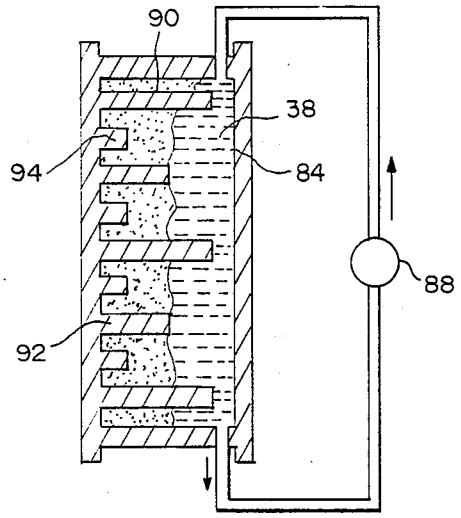
FIG. 8 is an alternative embodiment of the heat exchanger 12.

Alternatively, a plurality of short and long fins may extend from the low-temperature side 64. A heat exchanger of this type having longer fins 90, medium fins 92, and shorter fins 94 is illustrated in FIG. 8. The short and long fins may have a variety of lengths and alternate between short and long extending from the side 64. The heat exchanger of this type is designed to operate most of the time with all of the short fins frozen over and a portion of the longest fins exposed and a portion covered by solid heat transfer medium 38. In the event a large amount of heat is generated by the variable heat source 16, the heat transfer medium absorbs large amounts of heat while changing phase from solid to liquid. Further, the thermal conductance of the heat exchanger quickly increases. If shorter fins are exposed, the number of fins and the effective surface area sharply increase, thus increasing the thermal conductance of the heat exchanger by a step function and changing the slope of the heat transfer line. This may be provided as a safety feature in a heat exchanger used for a nuclear reactor or a heat exchanger used on an aircraft that may experience significant atmospheric heating due to atmospheric friction at certain times during a flight.

The particular design of the heat exchanger and selection of the heat transfer medium depend upon the system in which they will be used. In the event the heat exchanger is to be used on a transatmospheric vehicle, a heat exchanger value similar to that of FIG. 5 or 8 may be selected. While in space, the heat exchanger is operating with most or all of the heat transfer medium solid. The heat exchanger 12 is providing the required cooling for the space vehicle, such as for the electronics or the like. Because the heat is generated by a relatively constant heat source 18, the system can be designed to cool the structure the appropriate amount when all or most of the heat transfer medium 38 is in the solid phase. In the event of a sudden burst from the rocket engine, the heat transfer medium 38 is partially turned to liquid and the necessary heat is removed from the heat transport fluid. The heat transfer medium may then return to solid. In the event the vehicle begins to enter the atmosphere, the heat transfer medium is quickly thawed and a large amount of heat is taken from the heat transport fluid to ensure that all portions of the interior of the vehicle remain at the desired temperature. In the event the heat exchanger 12 is used in a nuclear reactor, the design of FIG. 6 may be selected using a relatively large heat exchanger, with long fins to operate properly even if the heat generated from the system varies over a large range. Accordingly, any desired heat exchanger configuration can be designed using the principals described herein.

I claim:

1. A heat transfer apparatus comprising:

a heat generating system including a heat transport fluid and a heat source;

a cooling system including a cryogen cooling fluid having heat transport properties that vary significantly as the cryogen cooling fluid circulates; and a heat exchanger assembly thermally isolating said heat generating system from said cooling system, said heat exchanger assembly including a high-temperature wall adjacent said heat generating system and a low-temperature wall thermally coupled to said cryogen cooling fluid of said cooling system and an interior volume, said heat exchanger assembly further including a plurality of fins extending from said low-temperature wall and a heat transfer medium circulating within said volume; a first set of said plurality of fins extending for a first length from said low-temperature wall; a second set of said plurality of fins extending for a second length longer than said first length from said low-temperature wall to provide a sharp increase in the thermal conductivity of said heat exchanger assembly when sufficient of said heat transfer medium changes from solid to liquid that said first set of fins which were previously surrounded by solid heat transfer medium are surrounded in part by circulating liquid heat transfer medium.

2. The apparatus of claim 1 wherein a tip of said fins is spaced from said second wall by a predetermined distance.

3. The apparatus of claim 2 wherein said predetermined distance is less than the length of said fins.

4. The apparatus of claim 2 wherein said predetermined distance is selected according to the desired difference in heat conductance of said apparatus at different temperatures of said interior volume.

5. The apparatus of claim 1 wherein said heat transfer medium is water.

6. The apparatus of claim 1 wherein said heat transfer medium is an alcohol.

7. The apparatus of claim 1 wherein said heat transfer medium is selected in turn from liquid phase to solid phase at a predetermined temperature.

8. The apparatus according to claim 7 wherein said predetermined temperature is selected to be lower than the temperature at which said heat transport fluid changes from fluid to solid.

9. The apparatus of claim 1 wherein said heat transfer structure has a relatively high thermal conductance when said heat transfer medium is in the fluid state and a relatively low thermal conductance when all of said heat transfer medium is in the solid state.

10. The apparatus of claim 1 wherein said heat transfer medium in the solid phase has a thermal conductivity less than said fins.

11. The apparatus of claim 1 wherein said heat transfer fluid conducts heat between said walls by natural or forced convection currents and by conduction when in the liquid state and conducts only by conduction when in the solid state.

12. The apparatus of claim 1 wherein the thermal conductivity of said fins is at least ten (10) times greater than the thermal conductivity of said heat transfer medium in the solid phase.

13. The apparatus of claim 1 wherein said heat transfer medium in the solid state is a relative thermal insulator.

14. The apparatus of claim 1 wherein a first portion of said heat transfer medium changes from liquid to solid and a portion remains liquid when the temperature of said low-temperature wall is below a first threshold temperature.

15. The apparatus of claim 1 wherein a second portion of said heat transfer medium changes from liquid to solid and a portion remains liquid when the temperature of said low-temperature wall is below a second threshold temperature.

16. The apparatus of claim 1 wherein the percentage of said heat transfer medium that is solid is dependent upon the temperature of said low-temperature wall and relative to the temperature of the high-temperature wall.

17. The apparatus according to claim 1 wherein the thermal conductance of said heat transfer device is determined by the percentage of the heat transfer medium which is in the fluid phase.

18. The apparatus according to claim 17 wherein said percentage of heat transfer medium in the fluid phase varies from 100% to 0%.

19. The apparatus according to claim 1 wherein said heat transfer medium changes from fluid to solid at a higher temperature then the temperature at which said heat transport fluid freezes.

20. The apparatus according to claim 1 wherein a portion of said heat transfer medium is in a fluid phase and circulates within said heat exchanger assembly and a portion of said heat transfer medium is in the solid phase and prevents circulation of fluid in that region occupied by the solid heat transfer medium.

21. The apparatus according to claim 1 wherein said circulation is by natural convection currents due to temperature differences within said heat transfer medium.

22. The apparatus according to claim 1 wherein said circulation is caused by a forced convection current means.

23. The apparatus according to claim 20 wherein the percentage of heat transfer medium which is in the fluid phase varies depending on a desired thermal conductance of said heat exchanger.

24. The apparatus according to claim 1, further including a third set of fins having a third, longer length than said second length to provide a sharp increase in the thermal conductivity of said heat exchanger assembly when sufficient of said heat transfer medium changes from solid to liquid that said first and second set of fins which were previously surrounded by solid heat transfer medium are surrounded in part by circulating liquid heat transfer medium.

25. The method of modifying the thermal conduction of a heat exchanger apparatus, comprising:

circulating a liquid portion of a heat transfer medium within an interior of said heat exchanger, said heat exchanger including a first set of fins having a first length and a second set of fins having a second, longer length than said first length, said first and second sets of fins extending from an interior wall and into said interior of said heat exchanger, said medium circulating over a first surface area of said fins;

lowering the temperature of said heat transfer medium by thermally coupling a cryogen cooling fluid with said heat exchanger, causing a sufficient portion of said heat transfer medium to change from fluid to solid to completely surround said first set of fins and a portion of the length of said second set of fins to sharply decrease the thermal conductivity of said heat exchanger; and circulating a portion of said heat transfer medium over a second surface area of said second set of fins, said second surface area being less than said first surface area.

26. The method according to claim 25 wherein said circulation is created by natural convection currents caused by differences in temperature within said heat transfer medium.

27. The method according to claim 15 wherein said circulation is created by a forced convection current means.

28. The method according to claim 25, further including placing relatively high-temperature fluid near said heat exchanger causing a portion of said heat transfer medium to change from solid to fluid.

* * * * *